US005420559A

United States Patent [19]

Ohshiba et al.

[11] Patent Number: 5,420,559

[45] Date of Patent: May 30, 1995

[54] COIL BOBBINS

[75] Inventors: Koichi Ohshiba; Hiromitsu Sakai, both of Fuji, Japan

[73] Assignee: Polyplastics Co., Ltd., Osaka, Japan

[21] Appl. No.: 35,586

[22] Filed: Mar. 23, 1993

[30] Foreign Application Priority Data

Mar. 31, 1992 [JP] Japan ..... 4-108933

[51] Int. Cl.[6] ..... H01F 27/30

[52] U.S. Cl. ..... 336/208; 336/198

[58] Field of Search ..... 336/208, 198

[56] References Cited

U.S. PATENT DOCUMENTS 5,321,572 6/1994 Shibui et al. ..... 361/38

FOREIGN PATENT DOCUMENTS 804827 11/1958 United Kingdom ..... 336/208

*Primary Examiner*—Leo P. Picard
*Assistant Examiner*—L. Thomas
*Attorney, Agent, or Firm*—Depaoli & Frenkel

[57] ABSTRACT

The present invention provides a coil bobbin manufactured by injection molding a thermoplastic resin with a mold having a cavity of a predetermined shape corresponding to the coil bobbin. The coil bobbin includes a tubular main body consisting of a tubular wall having an upper end and a lower end, an upper flange being formed to surround the upper end of the tubular wall and having a thinner wall portion and a thicker wall portion, a lower flange being formed to surround the lower end of the tubular wall and having an upper face and a bottom face, and a pair of feet protruded downward from the bottom face of the lower flange. The thinner wall portion has a thickness of not greater than a predetermined thickness of the tubular main body, and the thicker wall portion has a thickness of not less than the predetermined thickness. The predetermined thickness is not greater than 0.5 millimeter, and more specifically not greater than 0.2 millimeter. This structure of the invention makes the thin tubular wall free from undesirable weld marks or air pockets and allows a longer lead wire to be wound on the tubular wall to enhance the response of the electromagnetic coil.

12 Claims, 6 Drawing Sheets

COIL BOBBINS

BACKGROUND OF THE INVENTION

1. Field of the Invention

The present invention relates to a coil bobbin arranged in a printer head of a dot printer unit, and more specifically to a coil bobbin having a thinner main body to allow longer copper lead wire to be wound thereon. The invention also pertains to a method of molding such a coil bobbin.

2. Description of the Related Art

A typical example of conventional coil bobbin which is disposed in a printer head of a dot printer unit to hit dot pins against a typing sheet is shown in the perspective view of FIG. 8A and the longitudinal sectional view of FIG. 8B. The coil bobbin includes: a tubular main body 101 consisting of a tubular wall having an upper end and a lower end; an upper flange 102 and a lower flange 103 respectively formed on the upper end and the lower end of the main body 101; and a pair of feet 104 and 105 protruded downward from a lower face of the lower flange 103. There are gate marks 106 on the respective outer faces of the feet 104 and 105. Copper lead wire is wound on the circumference of the tubular main body 101 between the upper and lower flanges 102 and 103 to form an electromagnetic coil. The electromagnetic coil is then installed in the printer head via the pair of feet 104 and 105.

Such coil bobbins are generally manufactured by injection molding a thermoplastic resin. FIGS. 9A through 9D are short shot patterns showing a process of injection molding a thermoplastic resin into a coil bobbin with a mold (not shown) having a cavity of a certain shape corresponding to the coil bobbin.

The cavity of the mold is filled with the thermoplastic resin injected through a pair of tunnel gates formed in the mold. The tunnel gates are in contact with a cavity section corresponding to the pair of feet 104 and 105 at the position of the gate marks 106. The thermoplastic resin is injected into the cavity of the mold to form the respective parts of the coil bobbin in the following order: the pair of feet 104 and 105, the lower flange 103, the main body 101, and the upper flange 102, as clearly shown in FIGS. 9A through 9D.

With the recent demand for a smaller printer head, the coil bobbin is required to have a thinner tubular wall, which allows a greater winding number of lead wire with respect to a unit outer area of the tubular wall and thereby improves the response of an electromagnetic coil produced as a final product. When the tubular wall of the coil bobbin has a thickness of 0.1 through 0.2 millimeter, however, undesirable weld marks or air pockets are often observed on the thin tubular wall. Namely, the fraction defective increases and the production yield is worsened.

In the process of injection molding the tubular main body 101 after the pair of feet 104 and 105 and the lower flange 103 as shown in FIG. 9A, the flow of the thermoplastic resin reaches a cavity section corresponding to the upper flange 102 before completing formation of the tubular main body 101. The tubular wall of the main body 101 surrounds a substantially trapezoidal opening as seen in FIG. 8A. The thermoplastic resin successively fills a cavity section of the mold to complete the corners and smaller faces of the substantially trapezoidal tubular wall. The thermoplastic resin, however, starts forming the upper flange 102 before completing the larger faces of the trapezoidal tubular wall as seen in FIG. 9B. This is attributable to the greater thickness of the upper flange 102 than the tubular main body 101.

After completing formation of the upper flange 102, the thermoplastic resin fills a gap 107 formed between the tubular wall 101 and the upper flange 102 shown in FIG. 9C. This may cause a weld mark 108 or air pocket 109 on the thin tubular wall 101 as shown in FIG. 9D.

SUMMARY OF THE INVENTION

One object of the invention is thus to provide a coil bobbin which does not have undesirable weld marks or air pockets on its thin tubular wall.

Another object of the invention is to provide a method of injection molding such a coil bobbin.

Still another object of the invention is to provide a mold used for injection molding such a coil bobbin.

The above and other related objects are realized by a coil bobbin including: a tubular main body consisting of a tubular wall having an upper end and a lower end; an upper flange being formed to surround the upper end of the tubular wall of the tubular main body; a lower flange being formed to surround the lower end of the tubular wall of the tubular main body and having an upper face and a bottom face; and a pair of feet protruded downward from the bottom face of the lower flange. The upper flange further includes a thinner wall portion having a first top face and a first lower face opposite to the upper face of the lower flange, and a thicker wall portion having a second top face and a second lower face opposite to the upper face of the lower flange.

In the coil bobbin of the invention, the first lower face of the thinner wall portion and the second lower face of the thicker wall portion are positioned on an identical horizontal level, that is, the first lower face and the second lower face form a flat surface on a predetermined horizontal level, and the first top face of the thinner wall portion and the second top face of the thicker wall portion form a stepwise structure.

The thinner wall portion of the upper flange has a thickness of not greater than a predetermined thickness of the tubular main body, and the thicker wall portion has a thickness of not less than the predetermined thickness of the tubular main body. The predetermined thickness is not greater than 0.5 millimeter, and more specifically not greater than 0.2 millimeter.

The coil bobbin is mainly composed of a thermoplastic resin which may include liquid crystal polyester resin, poly(arylene sulfide) resin, or polyamide resin.

Such a coil bobbin is manufactured by injection molding the thermoplastic resin with a mold having a cavity of a predetermined shape corresponding to the coil bobbin. The mold of the invention includes a movable mold element having a first cavity corresponding to the pair of feet and a second cavity corresponding to the lower flange, and a fixed mold element having a third cavity corresponding to the upper flange and a forth cavity corresponding to the tubular main body. The mold further includes a pair of runners which the thermoplastic resin pass through, and a pair of tunnel gates connecting to the pair of runners and being in contact with the first cavity corresponding to the pair of feet.

The thermoplastic resin is injected into the cavity of the mold through the pair of runners and tunnel gates to form the pair of feet, the lower flange, main part of the tubular main body, the thicker wall portion of the upper flange, remaining part of the tubular main body, and the thinner wall portion of the upper flange in this order.

As described above, the upper flange of the coil bobbin according to the invention includes a thinner wall portion and a thicker wall portion. The thermoplastic resin fills a cavity section corresponding to the thinner wall portion of the upper flange after completing another cavity section corresponding to the tubular main body. This structure of the invention makes the sufficiently thin tubular wall free from undesirable weld marks or air pockets. The thin tubular wall allows a greater winding number of lead wire with respect to a unit outer area of the tubular wall and thereby improves the response of an electromagnetic coil produced as a final product.

These and other objects, features, aspects, and advantages of the present invention will become more apparent from the following detailed description of the preferred embodiment with the accompanying drawings.

DESCRIPTION OF THE PREFERRED EMBODIMENT

Figure 1:
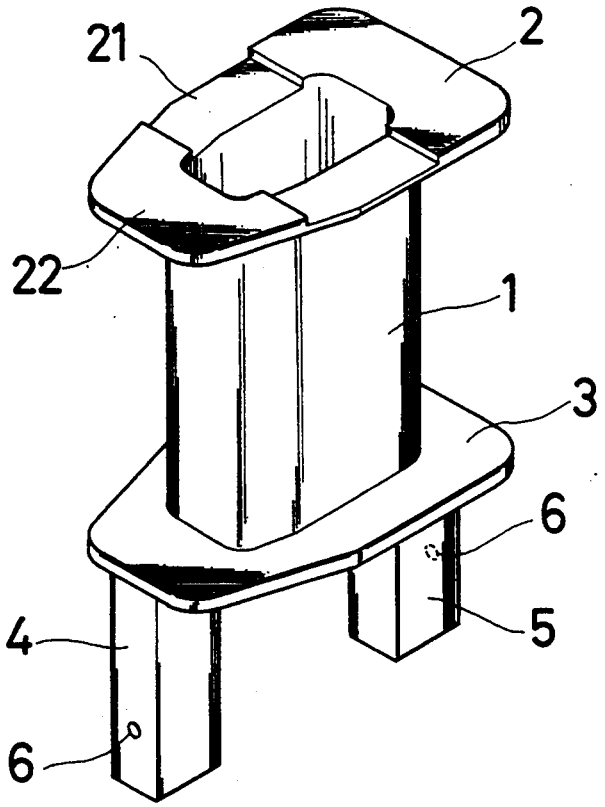
FIG. 1 is a perspective view showing a coil bobbin embodying the invention.
Figure 2:
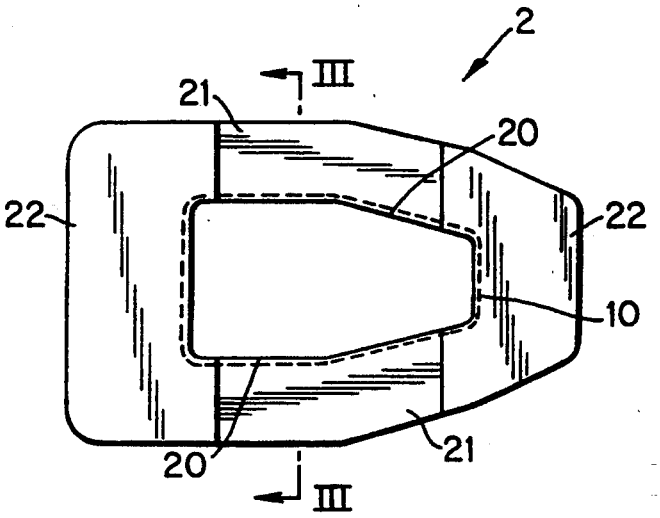
FIG. 2 is a plan view showing the coil bobbin of FIG. 1.

FIG. 1 is a perspective view showing a coil bobbin of a first embodiment according to the invention, and FIG. 2 is a plan view thereof. The coil bobbin of the first embodiment includes: a tubular main body 1 consisting of a tubular wall having an upper end and a lower end; an upper flange 2 and a lower flange 3 respectively formed on the upper end and the lower end of the tubular main body 1; and a pair of feet 4 and 5 protruded downward from a lower face of the lower flange 3. Each of the feet 4 and 5 has a gate mark 6 on the outer face thereof. Copper lead wire (not shown) is wound on the circumference of the tubular main body 1 between the upper flange 2 and the lower flange 3 to form an electromagnetic coil.

The coil bobbin is mainly composed of a thermoplastic resin which may include liquid crystal polyester resin, poly(arylene sulfide) resin, or polyamide resin.

As clearly seen in FIG. 2, the upper flange 2 surrounds a substantially trapezoidal opening at the upper end of the tubular main body 1. The upper flange 2 includes: a pair of thinner wall portions 21,21 formed along slightly bent longitudinal sides 20 of the trapezoidal opening; and a pair of thicker wall portions 22,22 formed along the other sides of the opening.

The tubular main body 1 has a thickness of not greater than 0.5 millimeter, and more specifically not greater than 0.2 millimeter; in the embodiment, the thickness of the tubular main body 1 is set equal to 0.1 millimeter. Each thicker wall portion 22 of the upper flange 2 has a thickness greater than that of the tubular main body 1, and is equal to 0.5 millimeter in the embodiment. Each thinner wall portion 21 of the upper flange 2 has a thickness between 0.03 and 0.5 millimeter, that is, less than that of the tubular main body 1, and is equal to 0.08 millimeter in the embodiment.

Figure 3:
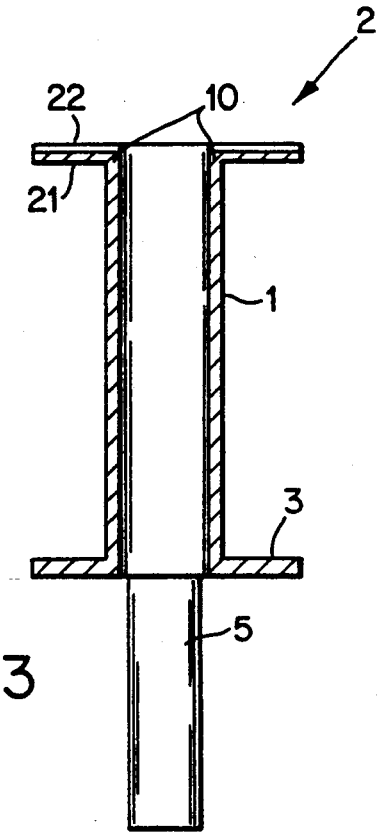
FIG. 3 is a longitudinal sectional view taken on the line III—III of FIG. 2.

FIG. 3 is a sectional view showing the coil bobbin of the first embodiment, taken on the line III—III of FIG. 2. As clearly seen in FIG. 3, the upper flange 2 is connected to the upper end of the tubular main body 1 via a joint face 10. The thinner wall portion 21 has an upper face positioned a little lower than an upper face of the thicker wall portion 22. Namely, the upper face of the thinner wall portion 21 and the upper face of the thicker wall portion 22 form a stepwise structure.

A lower face of the thinner wall portion 21 is, on the other hand, positioned on the same horizontal level as a lower face of the thicker wall portion 22. Namely, the lower faces form a flat surface on a certain horizontal level. The flat lower faces of the thinner wall portions 21 and the thicker wall portions 22 are uniformly in contact with copper lead wire wound on the tubular main body 1 to form a stable electromagnetic coil.

In this embodiment, the thinner wall portions 21 are formed along the slightly bent longitudinal sides 20 of the trapezoidal opening. The thinner wall portion 21 may, however, be formed in another part of the upper flange 2 corresponding to the shape of the opening at the upper end of the tubular main body 1.

Alternatively, the upper flange 2 may include at least one notch in place of the thinner wall portion 21. In this case, an insulator member is mounted between the lower face of the upper flange 2 and copper lead wire for better insulation effects.

Figure 4:
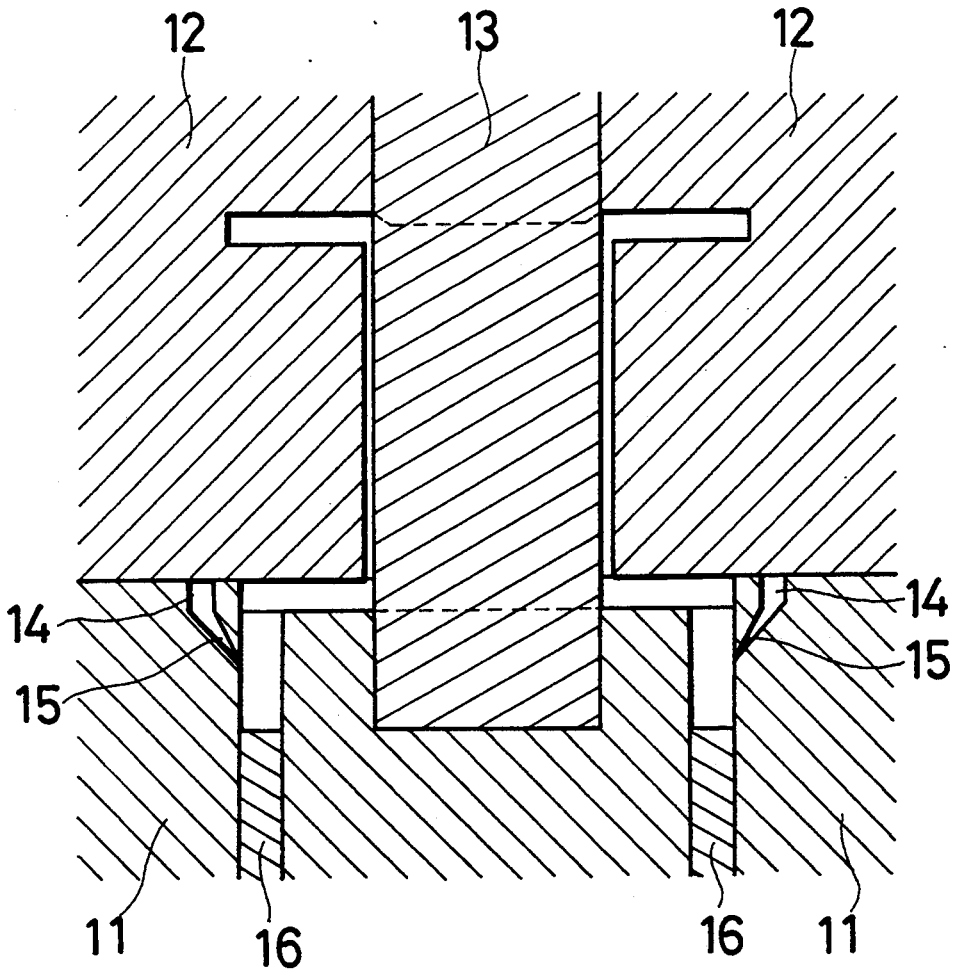
FIG. 4 is a sectional view schematically showing a mold used for injection molding the coil bobbin of FIG. 1.

FIG. 4 is a sectional view schematically showing a mold which has a cavity corresponding to the shape of the coil bobbin of FIG. 1 and is used for injection molding the coil bobbin. FIGS. 5A through 5E are short shot patterns showing a process of injection molding a thermoplastic resin into the coil bobbin of FIG. 1 with the mold of FIG. 4.

As shown in FIG. 4, the mold includes a movable mold element 11 having a first cavity corresponding to the pair of feet 4 and 5 of the coil bobbin of the first embodiment and a second cavity corresponding to the lower flange 3, and a fixed mold element 12 having a third cavity corresponding to the upper flange 2 and a forth cavity corresponding to the tubular main body 1. The fixed mold element includes a detachable core pin 13 for defining the inner face of the tubular main body 1. The core pin 13 is removed together with the produced coil bobbin from the fixed mold element 12 to sufficiently reduce a load applied onto the coil bobbin, which may cause damage on the thin tubular wall 1 and the thinner wall portion 21 of the upper flange 2.

The mold further includes a pair of runners 14 which the thermoplastic resin pass through, and a pair of tunnel gates 15 connecting to the pair of runners 14 and being in contact with the first cavity of the mold corresponding to the pair of feet 4 and 5. The points of contact between the tunnel gates 15 and the first cavity are left as the gate marks 6 on the feet 4 and 5. The mold also includes a pair of push pins 16 which are protruded into the first cavity corresponding to the pair of feet 4 and 5.

A thermoplastic resin, for example, liquid crystal polyester resin in the embodiment, is injected into the cavity of the mold through the pair of runners 14 and the tunnel gates 15 to form the pair of feet 4 and 5, the lower flange 3, main part of the tubular main body 1, the thicker wall portion 22 of the upper flange 2, remaining part of the tubular main body 1, and the thinner wall portion 21 of the upper flange 2 in this order as shown in FIGS. 5A through 5E.

Figure 5A:
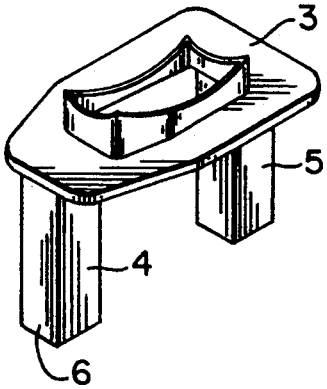
FIGS. 5A through 5E are short shot patterns showing a process of injection molding the coil bobbin of FIG. 1 with the mold FIG. 4.
Figure 5B:
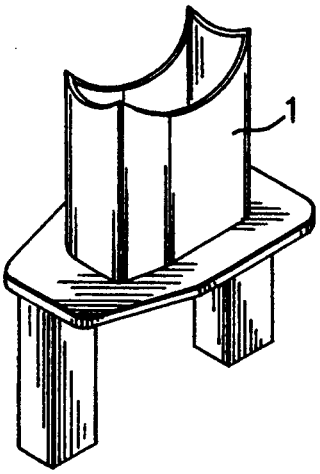
Figure 5C:
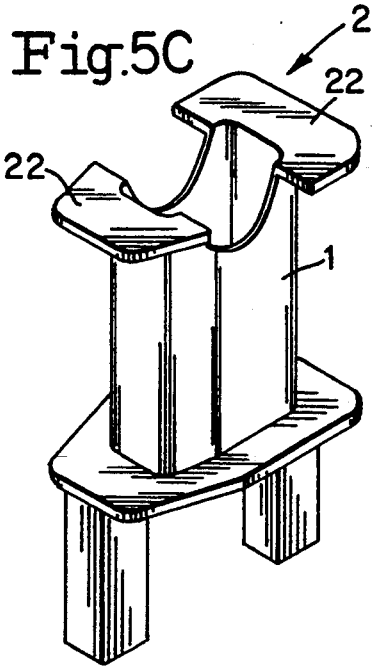
Figure 5D:
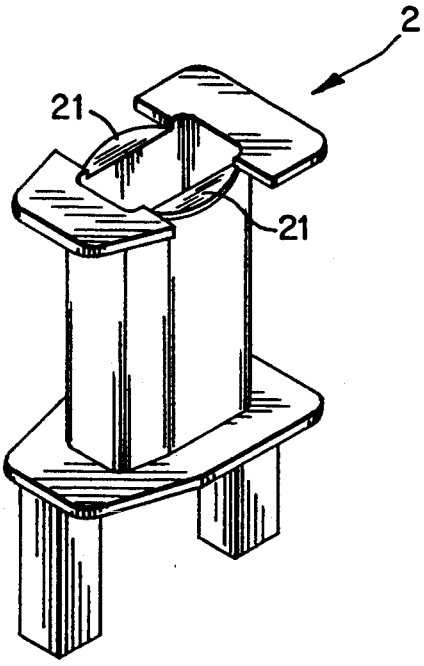
Figure 5E:
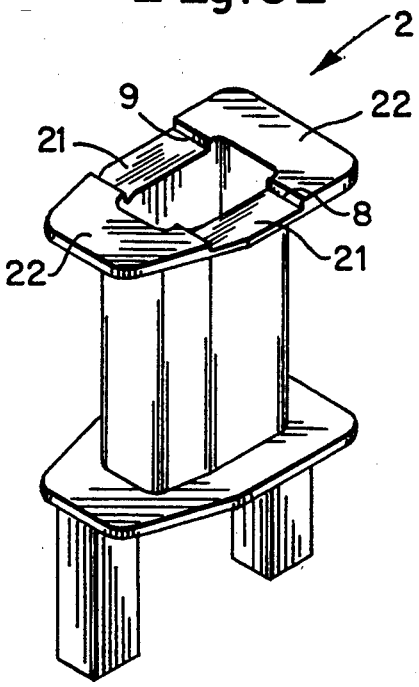
Figure 8A:
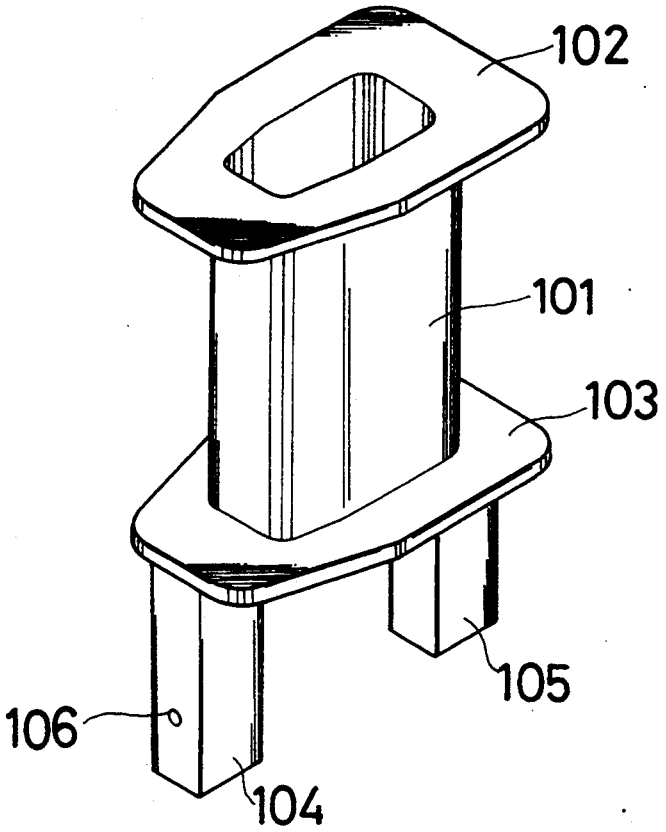
FIG. 8A PRIOR ART
FIG. 8A is a perspective view showing a conventional coil bobbin as a prior art.
Figure 8B:
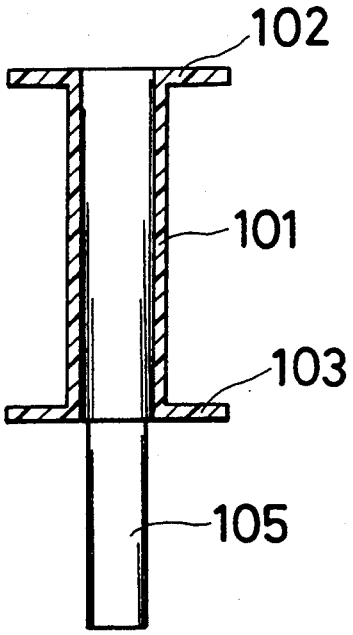
FIG. 8B PRIOR ART
FIG. 8B is a longitudinal sectional view showing the conventional coil bobbin of FIG. 8A.
Figure 9A:
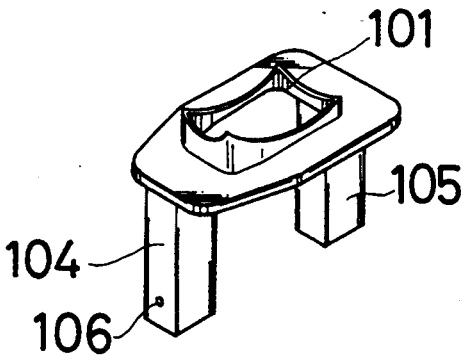
PRIOR ART FIG. 9A
FIGS. 9A through 9D are short shot patterns showing a process of injection molding the conventional coil bobbin of FIG. 8A.
Figure 9B:
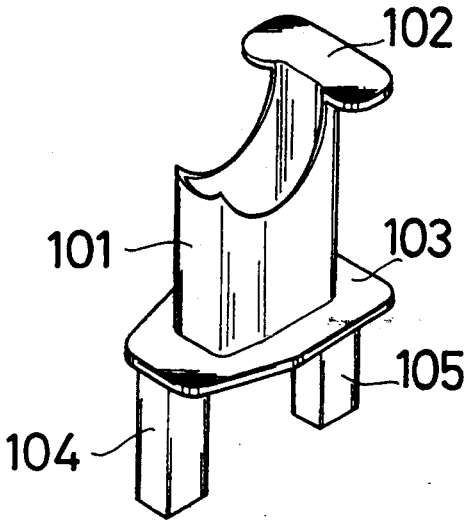
Figure 9C:
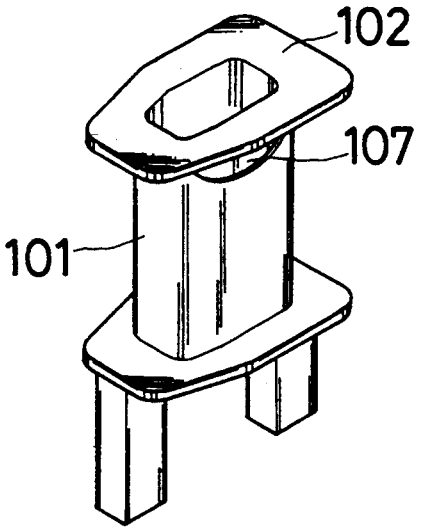
Figure 9D:
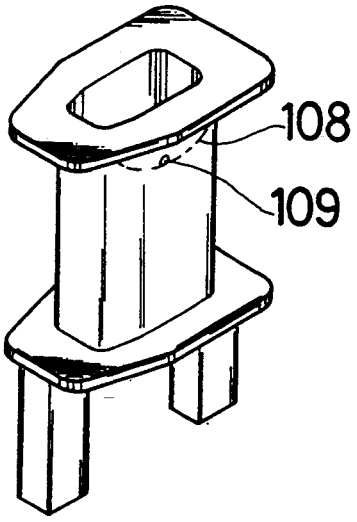

In the process of forming the tubular main body 1 after the pair of feet 4 and 5 and the lower flange 3 as shown in FIGS. 5A and 5B, the flow of the thermoplastic resin reaches a cavity section corresponding to the thicker wall portions 22,22 of the upper flange 2 before completing formation of the tubular main body 1 as shown in FIG. 5C. The thermoplastic resin fills a cavity section of the mold to complete the corners and smaller faces of the substantially trapezoidal tubular wall 1 as shown in FIG. 5B, and then fills a cavity section to form the thicker wall portions 22,22 having a larger thickness than the tubular wall 1 as shown in FIG. 5C. The thermoplastic resin then fills the remaining part of the tubular main body 1 having a greater thickness than the thinner wall portions 21,21 as shown in FIG. 5D, and lastly forms the thinner wall portions 21,21 of the upper flange 2 as shown in FIG. 5E.

The coil bobbin produced according to this method does not have undesirable weld marks or air pockets on the thin tubular wall 1. The coil bobbin may have a weld mark 8 or an air pocket 9 on the border between the thinner wall portion 21 and the thicker wall portion 22 of the upper flange 2, but this does not cause any problems.

The process of injection molding the thermoplastic resin into the coil bobbin takes approximately 0.1 second. Specific conditions of injection molding are given below:

Temperature of an injection nozzle: 350° C.,
Temperature of the mold: 120° C.,
Injection speed: 18 m/min, and
Injection power: 1,200 kgf/cm$^2$.

Figure 6:
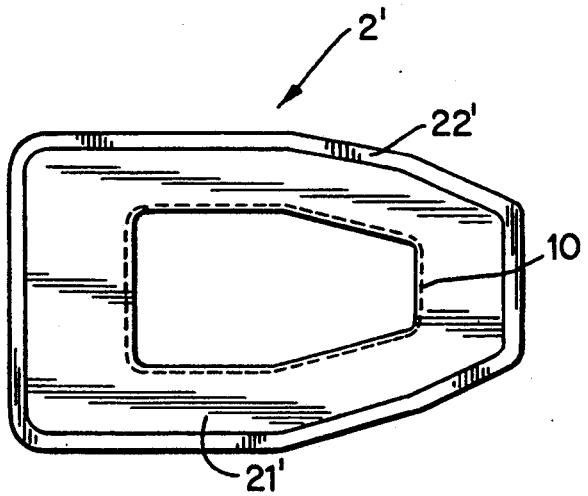
FIG. 6 is a plan view showing a coil bobbin of a second embodiment according to the invention.

FIG. 6 is a plan view showing another coil bobbin as a second embodiment of the invention. In this embodiment, an upper flange 2' includes a thinner wall portion 21' formed around a substantially trapezoidal opening of the thin tubular wall 1 via a joint face 10' and a thicker wall portion 22' of approximately 0.5 millimeter wide formed around the thinner wall portion 21'. The thinner wall portion 21' has the thickness of 0.08 millimeter, while the thicker wall portion 22' has the thickness of 0.5 millimeter. In this structure, lower faces of the thinner wall portion 21' and the thicker wall portion 22' form a flat surface on a predetermined horizontal level, while upper faces of the thinner and thicker wall portions 21' and 22' form a stepwise structure. The coil bobbin of the second embodiment includes the thicker wall portion 22' formed around the thinner wall portion 21' which further improves the strength of the upper flange 2. The other part of the coil bobbin of the second embodiment has the same structure as that of the first embodiment.

The coil bobbin of the second embodiment is produced with a mold (not shown) having a cavity corresponding to the predetermined shape of the coil bobbin. The thermoplastic resin fills the cavity of the mold to form the pair of feet 4 and 5, the lower flange 3, the tubular main body 1, and the thinner wall portion 21' and the thicker wall portion 22' of the upper flange 2' in this order. In the process of forming the tubular wall 1, the flow of the thermoplastic resin reaches a cavity section corresponding to the upper flange 2. The flow of the thermoplastic resin, however, moves to complete the tubular wall 1 first since the thinner wall portion 21 directly connecting with the joint face 10' of the tubular wall 1 has a smaller thickness than the tubular wall 1. The thermoplastic resin then successively fills the remaining part of the cavity to form the thinner wall portion 21' and the thicker wall portion 22' of the upper flange 2'.

Figure 7:
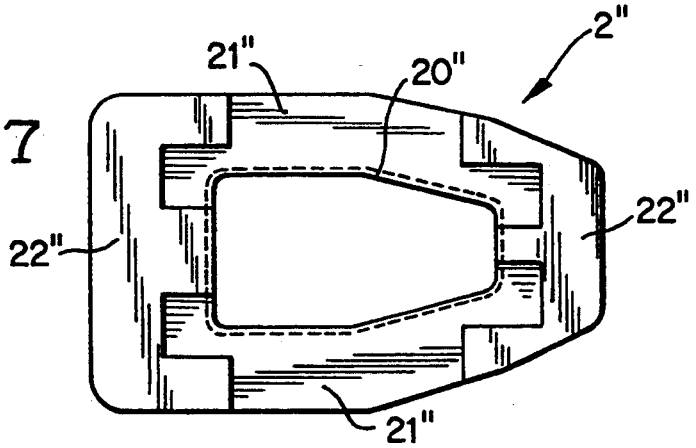
FIG. 7 is a plan view showing a coil bobbin of a third embodiment according to the invention.

FIG. 7 is a plan view showing another coil bobbin as a third embodiment of the invention. In this embodiment, an upper flange 2'' includes a pair of thinner wall portions 21'',21'' formed along slightly-bent longitudinal sides 20'' and four corners of a substantially trapezoidal opening, and a pair of thicker wall portions 22'',22'' formed along the other sides of the opening except the four corners. In this structure, lower faces of the thinner wall portions 21'',21'' and the thicker wall portions 22'',22'' form a flat surface on a predetermined horizontal level, while upper faces of the thinner and thicker wall portions 21'',21'' and 22'',22'' form a stepwise structure. The other part of the coil bobbin of the third embodiment has the same structure as that of the first embodiment.

In the coil bobbin of the third embodiment, the upper flange 2'' has the thicker wall portions 21'' on the inner corners thereof as well as along the longitudinal sides, which allows substantially simultaneous formation of the thinner wall portions 21'' and the thicker wall portions 22''. This structure is especially suitable for coil bobbins having greater difference in length between longer sides and shorter sides.

The coil bobbin of the third embodiment is produced with a mold (not shown) having a cavity corresponding to the predetermined shape of the coil bobbin. The thermoplastic resin fills the cavity of the mold to form the pair of feet 4 and 5, the lower flange 3, main part of the tubular main body 1, the thicker wall portions 22'' of the upper flange 2'', the remaining part of the tubular main body 1, and the thinner wall portions 21'' of the upper flange 2'' in this order as in the case of the first embodiment.

Since the invention may be embodied in other forms without departing from the scope or spirit of essential characteristics thereof, it is clearly understood that the above embodiment is only illustrative and not restrictive in any sense. The spirit and scope of the present invention is limited only by the terms of the appended claims.

What is claimed is:

1. A coil bobbin used as a base of an electromagnetic coil, said coil bobbin comprising:

a tubular main body having a thickness and consisting of a tubular wall having an upper end and a lower end;

an upper flange being formed to surround the upper end of said tubular wall of said tubular main body;

a lower flange being formed to surround the lower end of said tubular wall of said tubular main body and having an upper face and a bottom face; and a pair of feet protruded downward from said bottom face of said lower flange, said upper flange further comprising a thinner wall portion having a first top face and a first lower face opposite to the upper face of said lower flange, and a thicker wall portion having a second top face and a second lower face opposite to the upper face of said lower flange, said first lower face of said thinner wall portion and said second lower face of said thicker wall portion being positioned on an identical horizontal level and said first top face of said thinner wall portion and said second top face of said thicker wall portion forming a stepwise structure, said thinner wall portion of said upper flange having a thickness of not greater than the thickness of said tubular main body, and said thicker wall portion has a thickness of not less than said thickness of said tubular main body.

2. A coil bobbin in accordance with claim 1, wherein said thickness of said tubular main body is not greater than 0.5 millimeter.

3. A coil bobbin in accordance with claim 1, wherein said thickness of said tubular main body is not greater than 0.2 millimeter.

4. A coil bobbin in accordance with claim 2, wherein said thinner wall portion has a thickness between 0.03 millimeter and 0.5 millimeter.

5. A coil bobbin in accordance with claim 1 being mainly composed of a thermoplastic resin.

6. A coil bobbin in accordance with claim 5, wherein said thermoplastic resin comprises liquid crystal polyester resin.

7. A coil bobbin in accordance with claim 5, wherein said thermoplastic resin comprises poly(arylene sulfide) resin.

8. A coil bobbin in accordance with claim 5, wherein said thermoplastic resin comprises polyamide resin.

9. A coil bobbin in accordance with claim 1, wherein said tubular wall of said tubular main body surrounds a substantially trapezoidal opening.

10. A coil bobbin in accordance with claim 9, wherein said thinner wall portion is formed along slightly-bent longitudinal sides of said substantially trapezoidal opening, and said thicker wall portion is formed along the other sides of said substantially trapezoidal opening.

11. A coil bobbin in accordance with claim 9, wherein said thinner wall portion is formed around said substantially trapezoidal opening, and said thicker wall portion is formed around said thinner wall portion.

12. A coil bobbin in accordance with claim 9, wherein said substantially trapezoidal opening comprises four corners, slightly-bent longitudinal sides, and other sides, wherein said thinner wall portion is formed along said slightly-bent longitudinal sides and said four corners of said substantially trapezoidal opening, and said thicker wall portion is formed along said other sides of said opening except said four corners.

* * * * *